US011295640B2

(12) United States Patent
Lacy

(10) Patent No.: US 11,295,640 B2
(45) Date of Patent: Apr. 5, 2022

(54) UNFURLING BANNER GREETING CARD AND THE LIKE

(71) Applicant: HALLMARK CARDS INCORPORATED, Kansas City, MO (US)

(72) Inventor: Orlanda D. Lacy, Kansas City, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 71 days.

(21) Appl. No.: 16/664,500

(22) Filed: Oct. 25, 2019

(65) Prior Publication Data

US 2020/0058239 A1 Feb. 20, 2020

Related U.S. Application Data

(63) Continuation of application No. 15/879,119, filed on Jan. 24, 2018, now Pat. No. 10,475,360.

(51) Int. Cl.

| | |
|---|---|
| ***B42D 15/04*** | (2006.01) |
| ***G09F 15/00*** | (2006.01) |
| ***G09F 1/00*** | (2006.01) |
| ***G09F 21/02*** | (2006.01) |
| ***G09F 17/00*** | (2006.01) |

(52) U.S. Cl.

CPC ..... *G09F 15/0025* (2013.01); *G09F 1/00* (2013.01); *G09F 17/00* (2013.01); *G09F 21/02* (2013.01)

(58) Field of Classification Search

CPC ..... G09F 15/0025; G09F 21/02; G09F 17/00; G09F 1/00; G09F 1/04; G09F 11/29; G09F 2017/0033; B42D 15/045

USPC ..... 40/514–517; 116/173

See application file for complete search history.

(56) References Cited

U.S. PATENT DOCUMENTS

| | | | |
|---|---|---|---|
| 948,506 | A | 2/1910 | Horton |
| 2,337,210 | A | 12/1943 | Soldati |
| 2,490,621 | A | 12/1949 | R |
| 3,711,976 | A | 1/1973 | Allen |

(Continued)

FOREIGN PATENT DOCUMENTS

| | | | |
|---|---|---|---|
| GB | 2112987 | A | 7/1983 |
| WO | 2007011109 | A1 | 1/2007 |

OTHER PUBLICATIONS

US 8,557,280 B2, 10/2013, Manku (withdrawn)

(Continued)

*Primary Examiner* — Cassandra Davis

(74) *Attorney, Agent, or Firm* — Shook, Hardy & Bacon LLP

(57) ABSTRACT

Embodiments comprise a greeting card with a self-retracting, pullout banner comprising banner content that may supplement a message or artwork included on panels of the greeting card. The self-retracting banner can be attached to different portions of the greeting card. The self-retracting banner may be affixed to an edge of the greeting card. A user may extend the banner by pulling a handle away from the greeting card. As such, the self-retracting banner is movable to and between a fully retracted and closed first position and a fully extended and open second position. The self-retracting banner can be at least partially concealed within a compartment attached to a portion of the greeting card, for example, the front panel.

20 Claims, 5 Drawing Sheets

(56) References Cited

U.S. PATENT DOCUMENTS

| | | | | |
|---|---|---|---|---|
| 4,030,842 | A | 6/1977 | White et al. | |
| 5,176,774 | A | 1/1993 | Laniado et al. | |
| 5,906,063 | A | 5/1999 | Magee | |
| 5,966,854 | A | 10/1999 | Walsh et al. | |
| 6,301,812 | B1 | 10/2001 | Klunk | |
| 7,373,703 | B1 * | 5/2008 | Grenci | A61G 17/08 27/1 |
| 7,866,472 | B2 | 1/2011 | Aylward | |
| 7,901,213 | B1 * | 3/2011 | Beno | B43L 1/00 434/412 |
| 8,016,506 | B2 | 9/2011 | Adamberry | |
| 8,235,424 | B2 | 8/2012 | Garcia | |
| 8,322,058 | B2 | 12/2012 | Mayer et al. | |
| 9,061,539 | B1 | 6/2015 | Parkinson et al. | |
| 9,156,300 | B2 | 10/2015 | Parkinson et al. | |
| 9,545,811 | B2 | 1/2017 | Talbot et al. | |
| 10,699,601 | B2 * | 6/2020 | Lacy | G09F 27/00 |
| 2004/0049958 | A1 | 3/2004 | Eisen et al. | |
| 2004/0251376 | A1 | 12/2004 | Flis | |
| 2004/0258455 | A1 | 12/2004 | Brunetti | |
| 2005/0227214 | A1 | 10/2005 | Clegg | |
| 2008/0005942 | A1 | 1/2008 | Harney | |
| 2009/0080965 | A1 | 3/2009 | Adamberry | |
| 2009/0272832 | A1 | 11/2009 | Gantzer | |
| 2010/0162601 | A1 | 7/2010 | Kim | |
| 2013/0305573 | A1 | 11/2013 | Nemeth et al. | |
| 2019/0228688 | A1 | 7/2019 | Lacy | |

OTHER PUBLICATIONS

Notice of Allowance received for Canadian Patent Application No. 3,030,818, dated Nov. 30, 2020, 1 page.

Office Action received for Canadian Patent Application No. 3030818, dated Feb. 20, 2020, 4 pages.

Examination Report received for GB Patent Application No. 1900937.2, dated Mar. 5, 2020, 2 pages.

Notice of Allowance dated Mar. 26, 2020, in U.S. Appl. No. 16/428,640, 10 pages.

* cited by examiner

UNFURLING BANNER GREETING CARD AND THE LIKE

CROSS-REFERENCE TO RELATED APPLICATIONS

This application is a continuation application of co-pending U.S. patent application Ser. No. 15/879,119, filed Jan. 24, 2018, and entitled "UNFURLING BANNER GREETING CARD AND THE LIKE," the contents of which is incorporated herein by reference in the entirety.

TECHNICAL FIELD

The present invention relates generally to self-retracting banner extensions. More particularly, the present invention relates generally to self-retracting banner extensions in products that contain two hinged planes that move toward and away from one another, for example, greeting cards, books, invitations, boxes, and other objects with flaps.

BACKGROUND

Technology may be added to a greeting card or the like to make a compelling event occur when a consumer interacts with the greeting card or similar object. Historically, card content has been limited to the front, back, or inside portions of a card. It is desirable to provide an additional portion to extend the theme of the card beyond the front, back, and inside portions, while maintaining a similar form factor as found in a typical card. The card can include decorative content and expressive content that can be easily viewed by a person holding the card, but difficult for people more than a few feet away to view. It is desirable to create the compelling event anywhere that adds content, especially large content that is viewable at a distance.

SUMMARY

This summary is provided to introduce a selection of concepts in a simplified form that are further described below in the detailed description section. This summary is not intended to identify key features or essential features of the claimed subject matter, nor is it intended to be used as an aid in determining the scope of the claimed subject matter. The scope of the invention is defined by the claims.

The technology described herein relates to a self-retracting banner extension in a consumer product having communicative content. The banner can include content that complements the content on the consumer product. The product can contain two hinged planes that move toward and away from one another, for example, greeting cards, books, invitations, boxes, and other objects with flaps. In one embodiment, embodiments comprise a greeting card with a self-retracting, pullout banner comprising banner content that may supplement a message or artwork included on panels of the greeting card. In one embodiment, a greeting card having an unfurling banner may comprise a panel having at least a first subpanel and a second subpanel. The first subpanel and the second subpanel may be separated by a fold in the panel. In another aspect, a greeting card can take the form of a single panel, similar to a post card.

The banner can be attached to a different portion of the greeting card. The banner may be affixed to an edge of the greeting card. The banner may be attached to the edge of the greeting card at one end and with a handle at an opposite end. A user may extend the banner by pulling the handle away from the greeting card. As such, the banner is movable to and between a fully retracted and closed first position and a fully extended and open second position. The banner remains in the first position until the user pulls the handle and will automatically retract to the first position as the user releases the handle.

In an embodiment, the banner can be concealed within a compartment attached to a portion of the greeting card, for example, the front panel.

The banner can be made of a material that includes polyethylene terephthalate "PET", which provides a "spring-loaded" property. The use of PET allows the banner to move back to the closed position without use of a separate spring loading mechanism in the spool or elsewhere on the card.

In an embodiment, the greeting card may include a sound activation feature that is tied to the banner movement. For example, a sound may be emitted as the banner is pulled from a closed position to an open position. The sound may stop upon the banner reaching its full position.

BRIEF DESCRIPTION OF THE SEVERAL VIEWS OF THE DRAWINGS

The present invention is explained in more detail below with reference to the embodiments illustrated in the attached drawing figures, in which like reference numerals denote like elements, in which FIGS. 1-8 illustrate but four possible embodiments of the present invention, and in which:

FIG. 1 is a front perspective view of a greeting card in an open position, in accordance with an embodiment of the present invention;

FIG. 2 is a front perspective view of the greeting card of FIG. 1, but with the banner transitioning from a closed position to an open position;

FIG. 3 is a front perspective view of the greeting card of FIG. 1, but with the banner in a fully open position;

FIG. 4 is the greeting card of FIG. 1, showing a top view of a cross section of the banner and handle in a closed position;

FIG. 5 is a front perspective view of a greeting card with an unfurling banner partially concealed in a compartment attached to a front panel of the greeting card;

FIG. 6 is a side view of the greeting card of FIG. 5;

FIG. 7 is a front perspective view of the greeting card of FIG. 5, but with the banner transitioning from a closed position to an open position; and FIG. 8 is a front perspective view of the greeting card of FIG. 5, but with the banner in a fully open position.

DETAILED DESCRIPTION

Figure 1:
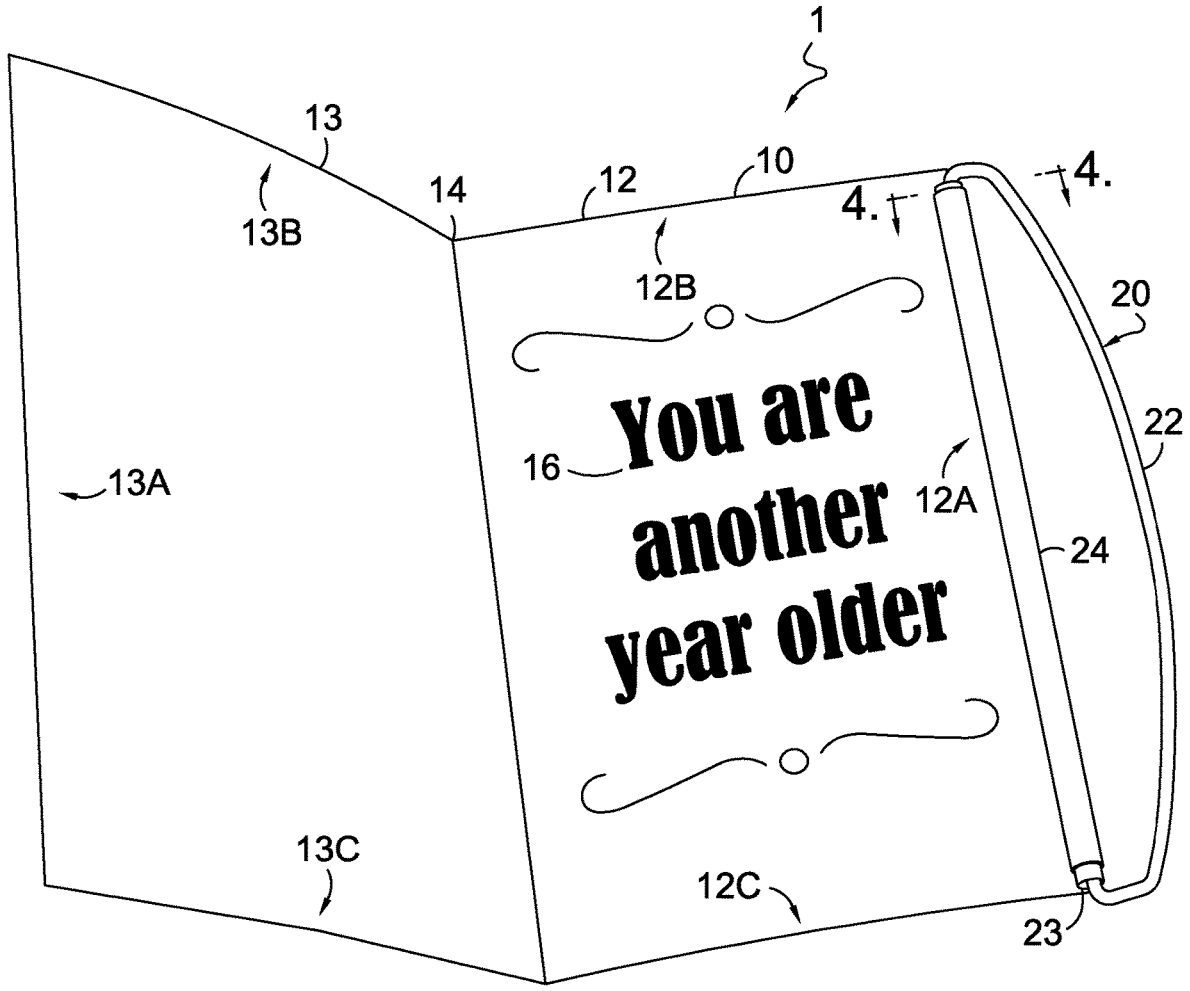

The subject matter of the present invention is described with specificity herein to meet statutory requirements. However, the description itself is not intended to limit the scope of this patent. Rather, the inventors have contemplated that the claimed subject matter might also be embodied in other ways, to include different steps or a combination of steps similar to the ones described in this document, in conjunction with other present or future technologies.

The technology described herein relates to a self-retracting banner extension in a consumer product having communicative content. The banner can include content that complements the content on the consumer product. The product can contain two hinged planes that move toward and away from one another, for example, greeting cards, books, invitations, boxes, and other objects with flaps. In one embodiment, embodiments comprise a greeting card with a self-retracting, pullout banner comprising banner content that may supplement a message or artwork included on panels of the greeting card. In one embodiment, a greeting card having an unfurling banner may comprise a panel having at least a first subpanel and a second subpanel. The first subpanel and the second subpanel may be separated by a fold in the panel. In another aspect, a greeting card can take the form of a single panel, similar to a post card.

The self-retracting banner can be attached to a different portion of the greeting card. The self-retracting banner may be affixed to an edge of the greeting card. The banner may be attached to the edge of the greeting card at one end and with a handle at an opposite end. A user may extend the banner by pulling the handle away from the greeting card. As such, the self-retracting banner is movable to and between a fully retracted and closed first position and a fully extended and open second position. The self-retracting banner remains in the first position until the user pulls the handle and will automatically retract to the first position as the user releases the handle.

In an embodiment, the self-retracting banner can be concealed within a compartment attached to a portion of the greeting card, for example, the front panel.

The self-retracting banner can be made of a material that includes polyethylene terephthalate "PET", which provides a "spring-loaded" property. The use of PET allows the self-retracting banner to move back to the closed position without use of a separate spring loading mechanism in the spool or elsewhere on the card.

In an embodiment, the greeting card may include a sound activation feature that is tied to the banner movement. For example, a sound may be emitted as the banner is pulled from a closed position to an open position. The sound may stop upon the banner reaching its full position.

Referring now to the drawings in more detail, wherein like reference characters designate like parts throughout the different views, and initially to FIGS. 1-7, a greeting card 1 having a self-retracting banner apparatus 20 is depicted, in accordance with a first embodiment of the present invention. The greeting card 1 includes a panel 10, a self-retracting banner apparatus 20 coupled to the panel 10, and a decorative card content 16. In some embodiments, the greeting card 1 may further include a cover (not shown).

The panel 10 may include two or more subpanels and at least one fold. For example, the panel 10 may include a first subpanel 12 and a second subpanel 13 separated from one another by a first fold 14. Some embodiments of the panel 10 may include additional subpanels. The first subpanel 12 can include an interior-facing side and an exterior-facing side (not visible). Both the interior and exterior facing sides can include decorative card content, including artwork and writing. The second subpanel 13 can likewise include an interior-facing side and an exterior-facing side (not visible). Both the interior and exterior facing sides can include decorative card content, including artwork and writing. The interior facing sides are only visible when the card is in an unfolded position. The exterior facing sides may be visible in either the folded or the unfolded position, depending on card orientation.

Each of the greeting card 1 and the panel 10 may have a folded position and an unfolded position. In some embodiments, the unfolded position of the greeting card 1 (shown in FIG. 1) may correspond to the unfolded position of the panel 10 (shown in FIG. 1). The folded position of the greeting card 1 may have an interior portion and an exterior portion. The interior portion of the greeting card 1 may be obscured from view when the greeting card 1 is in the folded position (i.e., closed) and may be exposed when the greeting card 1 is in the unfolded position (i.e., open).

The panel 10 may include one or more windows for viewing (not shown) the interior portion of the greeting card 1 when the greeting card 1 is in the folded position. For example, the second subpanel 13 may include a window through which an interior portion of the greeting card 1 (such as part of the decorative card content 16) may be viewed.

The decorative card content 16 may be affixed to the panel 10. For example, the decorative card content 16 may be affixed to the first subpanel 12. In one embodiment, the decorative card content 16 is printed onto the panel 10.

The greeting card 1 includes a self-retracting banner apparatus 20 attached to a right-vertical edge 12A of the first subpanel 12. The top-horizontal edge 12B of the first subpanel 12 and the bottom-horizontal edge 12C of the first subpanel 12 are alternative attachment locations that may be used in some embodiments. In one embodiment (not shown), a self-retracting banner is attached to more than one edge of the greeting card 1. For example, a self-retracting banner could also be attached to the left-vertical edge 13A of the second subpanel 13. The top-horizontal edge 13B of the second subpanel 13 and the bottom-horizontal edge 13C of the second subpanel 13 are alternative attachment locations that may be used in some embodiments.

Figure 2:
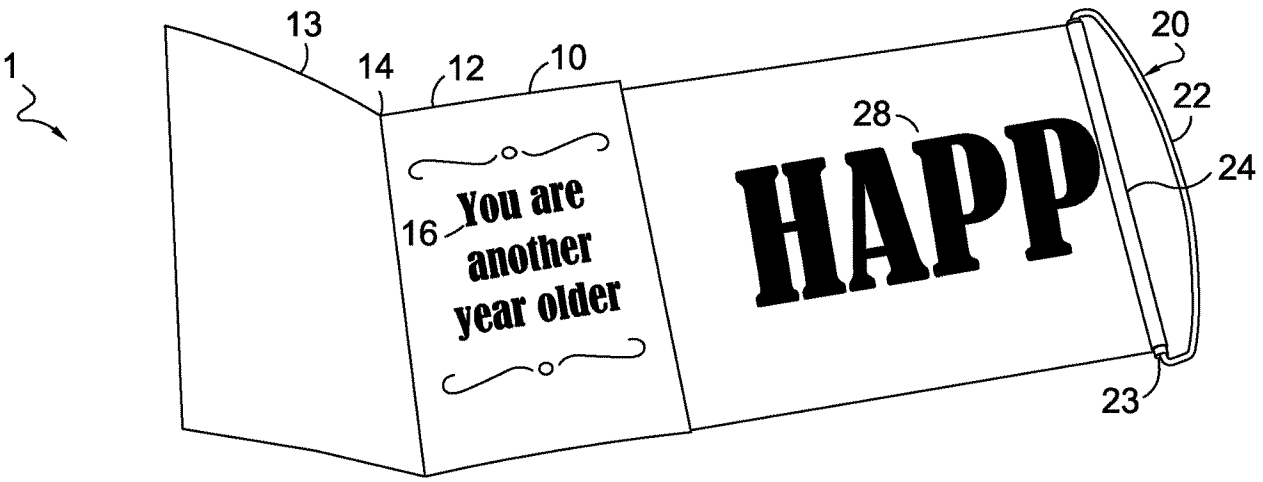
Figure 3:
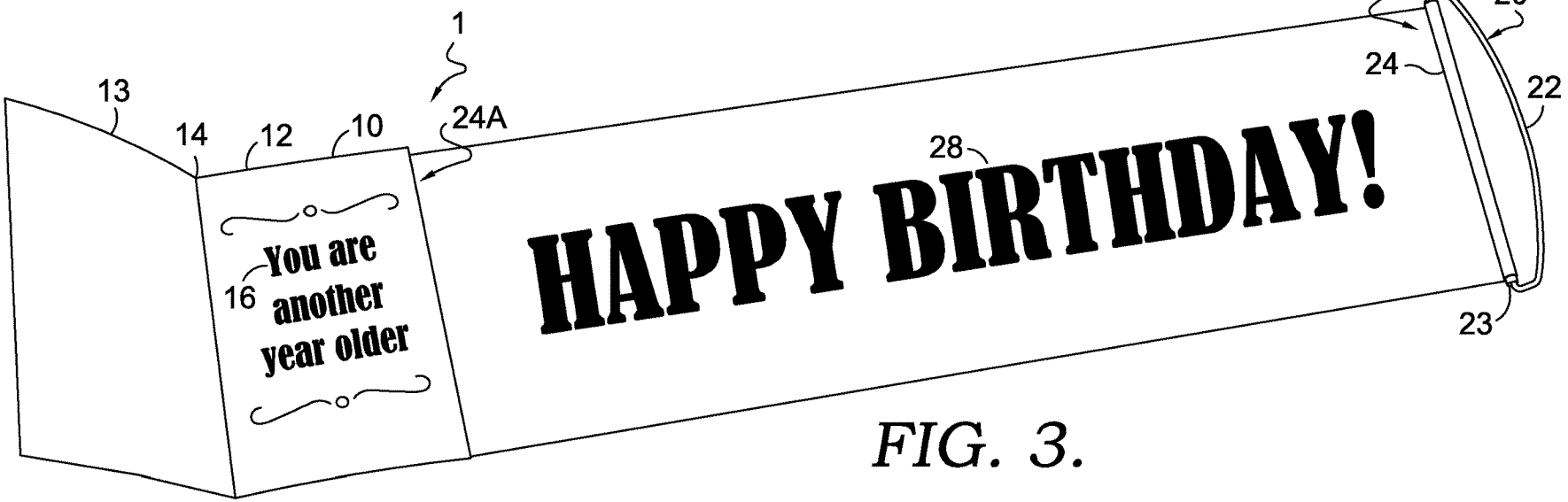

The self-retracting banner apparatus 20 comprises a handle 22, an unfurling banner 24, and a spool 23. A user may extend the unfurling banner 24 by pulling the handle 22 away from the greeting card 1. As such, the unfurling banner 24 is movable to and between a fully retracted (as shown in FIG. 1) and closed first position (as shown in FIG. 1) and a fully extended and open second position (as shown in FIG. 3). The unfurling banner 24 remains in the first position until the user pulls the handle and will automatically retract to the first position as the user releases the handle. FIG. 2 shows the unfurling banner 24 in a mid-extension position.

The unfurling banner 24 includes content 28 that complements the decorative card content 16 on the greeting card 1. The content reads, "Happy Birthday!", which complements the decorative card content 16, which reads, "You are another year older." As can be seen, the unfurling banner 24 is about the same height as the card 1, but is several times longer. In one embodiment, the unfurling banner 24 is at least twice as long as the greeting card 1 is wide. For example, the unfurling banner 24 can have a length that is 2.5 times the card width, 3 times the card width, 3.5 times the card width, 4 times the card width, 5 times the card width, or longer.

The font size on the unfurling banner 24 can also be several times larger than the font size used on the decorative portion 16. In one embodiment, the font size on the unfurling banner 24 is at least twice as large as the font size on the decorative portion 16. For example, the unfurling banner 24 can have a font size that is 2.5 times the font size on the decorative card content 16, 3 times the font size on the decorative card content 16, 3.5 times the font size on the decorative card content 16, 4 times the font size on the decorative card content 16, 5 times the font size on the decorative card content 16, or longer.

The card content and banner content can be related. For example, the banner content and card content in combination can complete a single message. For example, the banner content and the card content can form a single phrase or sentence when combined. In another embodiment, the banner content can answer a question posed by the card content.

The card content and banner content can use the same decorative themes, such as the same text colors and fonts. The background color can be used on both the card and the unfurling banner 24. The handle 22 can also be the same color as the unfurling banner 24.

The banner can be made of a material that includes Polyethylene Terephthalate "PET", which provides a "spring-loaded" property. In other words, the banner can return to its original spooled configuration once the force holding it in the open position is removed. The use of PET allows the banner to move back to the closed position without use of a separate spring loading mechanism in the spool or elsewhere on the card. In other words, the unfurling banner 24 can transition from open to closed automatically when the user removes his hand from the banner.

Figure 4:
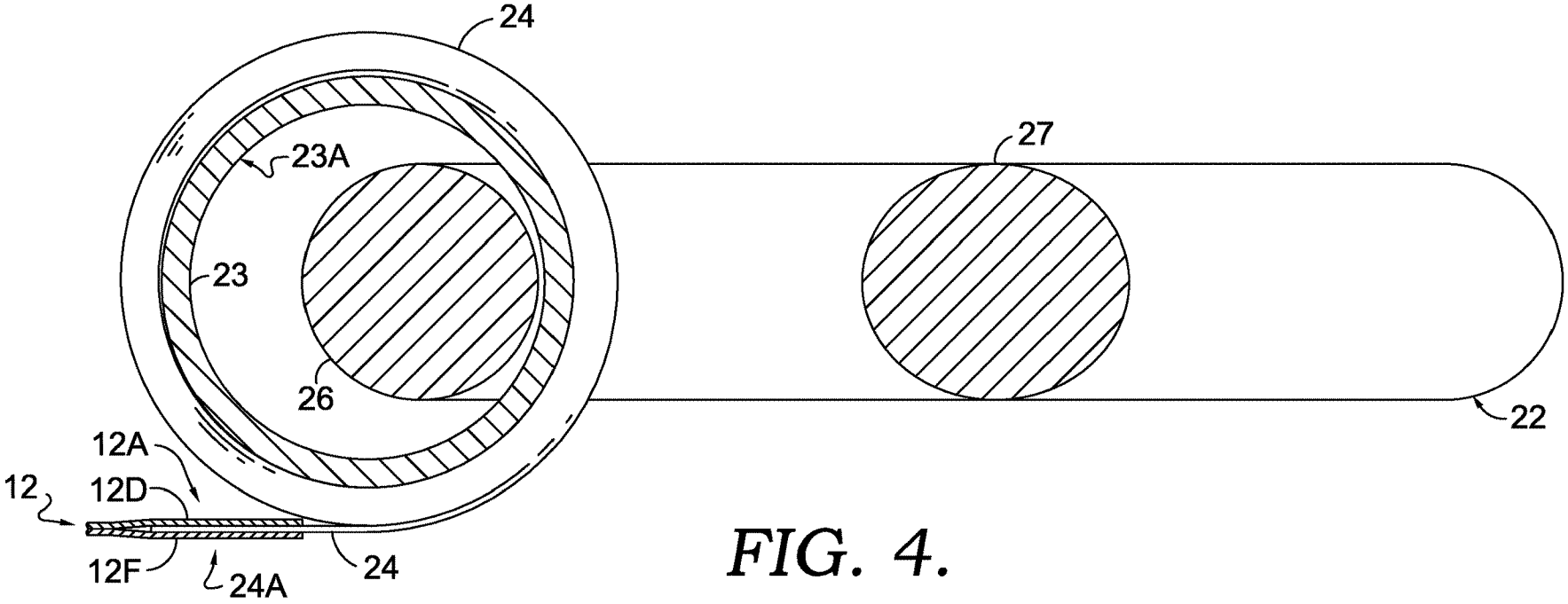

Turning now to FIG. 4, a cross-section of the self-retracting banner apparatus 20 is shown. The unfurling banner 24 is attached between a first ply 12D and a second ply 12F of the first subpanel 12 at the right-vertical edge 12A. A second end 24A of the unfurling banner 24 may be attached to the first ply 12D and the second ply 12F using an adhesive between the unfurling banner 24 and the first ply 12D and between the unfurling banner 24 and the second 12F. The opposite end of the banner, a first end 24B of the unfurling banner (as shown if FIG. 3), can be attached to the spool 23. The spool 23 can be formed from a suitable plastic, fiberglass, metal, or some other suitable material. An end of the unfurling banner 24, such as the first end 24B (as shown in FIG. 3), can be adhered to the spool, threaded through a slot in the spool, or otherwise attached to the spool to keep the spool and unfurling banner 24 coupled.

The handle 22 can loop outward from the spool 23 to allow room for a hand to fit between the handle 22 and the spool 23. As cross-section 27 shows, the handle 22 can be substantially cylindrical. The handle 22 includes a spool rod 26 that passes through at least a portion of the spool's inner circumference 23A. In one embodiment, the handle 22 can be bent to allow the ends of the spool rod 26 to be inserted into the inner circumference of the spool 23. The ends of the spool rod 26 can penetrate the inner circumference volume of the spool 23 a sufficient distance that the spool 23 is not easily removed from the spool rod 26. In an embodiment, the self-retracting banner apparatus 20 does not include a spring-loaded mechanism to power a self-retracting function.

Figure 5:
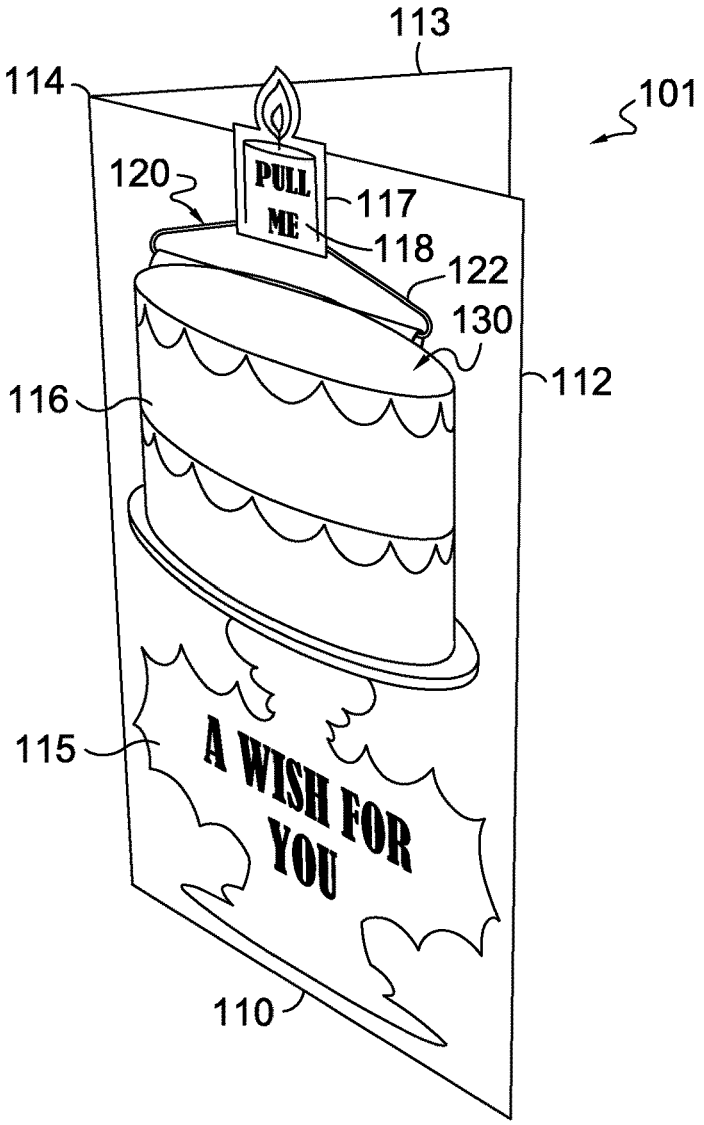

Turning to FIG. 5, the greeting card 101 may include many of the same features as the greeting card 1 (discussed above in reference to FIGS. 1-4). For example, the greeting card 101 may include a panel 110 having multiple subpanels each separated by a fold. Referring to FIG. 5, the panel 110 includes a first subpanel 112 and a second subpanel 113 separated by a fold 114.

The self-retracting banner apparatus 120 is partially concealed by a front portion 116 of container 130. The container 130 is attached to the exterior-facing side of the first subpanel 112. This is just one example of a suitable attachment point for a container that conceals, or partially conceals, the self-retracting banner apparatus 120. The handle 122 includes a tab 117 with a "pull me" message 118 providing instruction for the user to follow. The front portion 116 of the container 130 has the appearance of a birthday cake, which complements the decorative card content 115 on the card 101.

Figure 6:
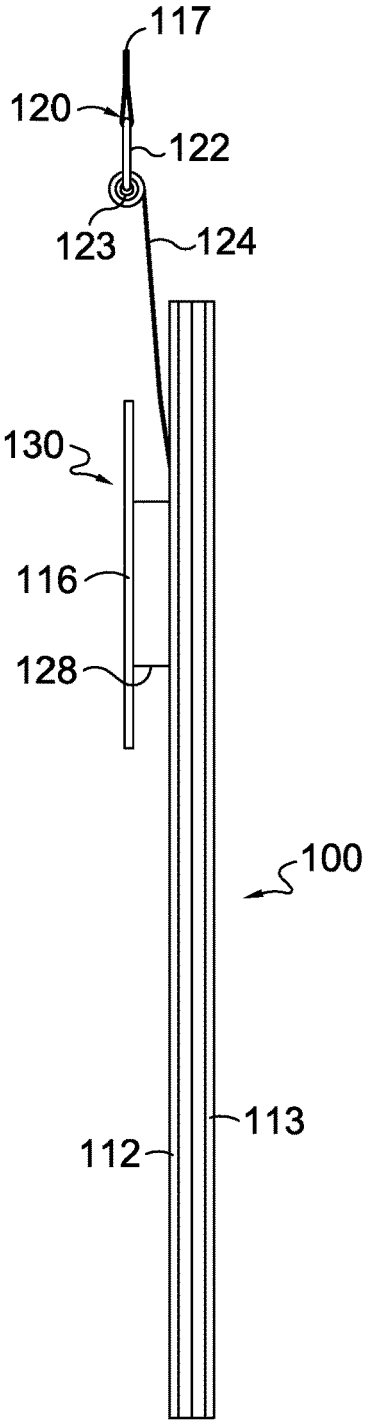

FIG. 6 shows a side view of the card and more details of the self-retracting banner apparatus 120, which is partially transitioned from the closed position (shown in FIG. 4) to an open position. The front portion 116 of the container 130 is attached to the exterior of the first subpanel 112 by a connector 128. Though not shown, one or more other connectors can be located in parallel with the connector 128. The vertical connector can be shaped as a flat bar, a C-shaped channel, an I-Beam, or other suitable shape adapted to couple the front portion 116 to the first subpanel 112. The connector is shown in a vertical alignment, but a horizontal connector could be used in combination. The width of the connector 128 can be sufficient to allow the self-retracting banner apparatus 120 to be located entirely or partially between the front portion 116 and the first subpanel 112. The size of the connector 128 may also leave room for movement of the self-retracting banner 120.

One end of the unfurling banner 124 is coupled to the exterior-facing side of the first subpanel 112. The coupling may be made by an adhesive or some other means. The self-retracting banner apparatus 120 can take a form similar to the form described previously with reference to FIG. 4. The self-retracting banner apparatus 120 includes a handle 122 that is coupled to the spool 123 in a manner that allows the spool to rotate freely. The unfurling banner 124 wraps around the spool 123 while in the closed position.

Figure 7:
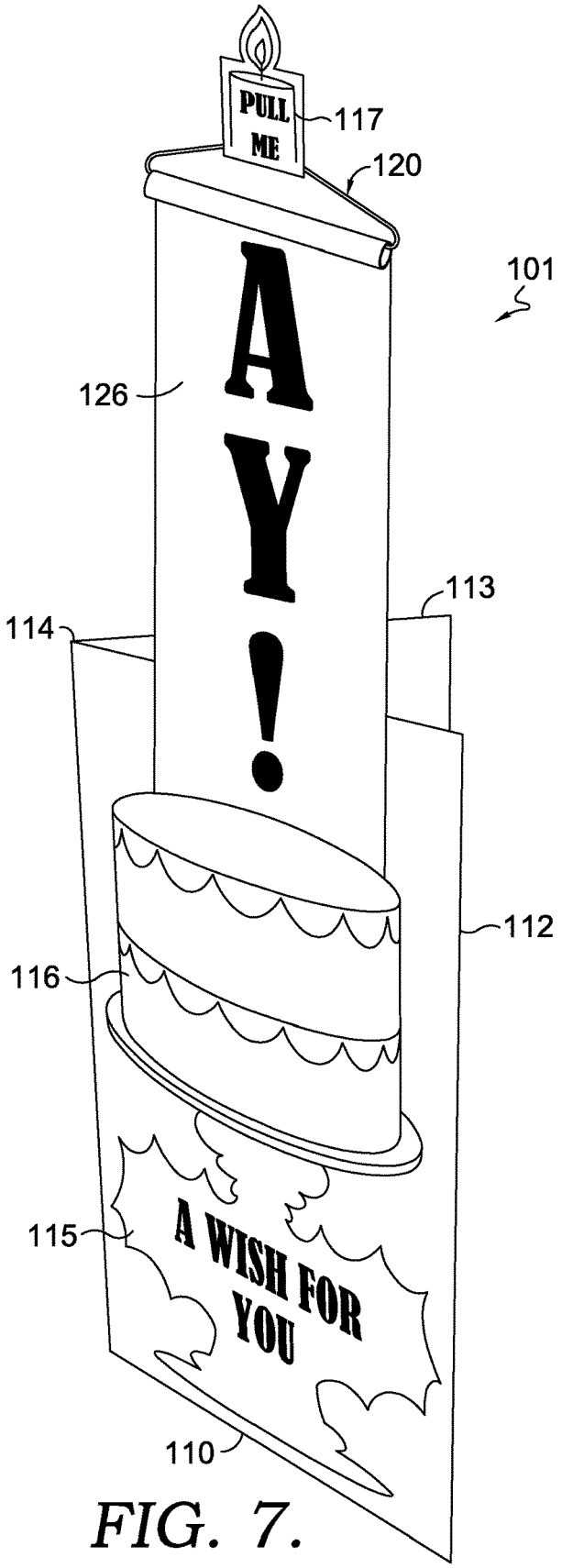
Figure 8:
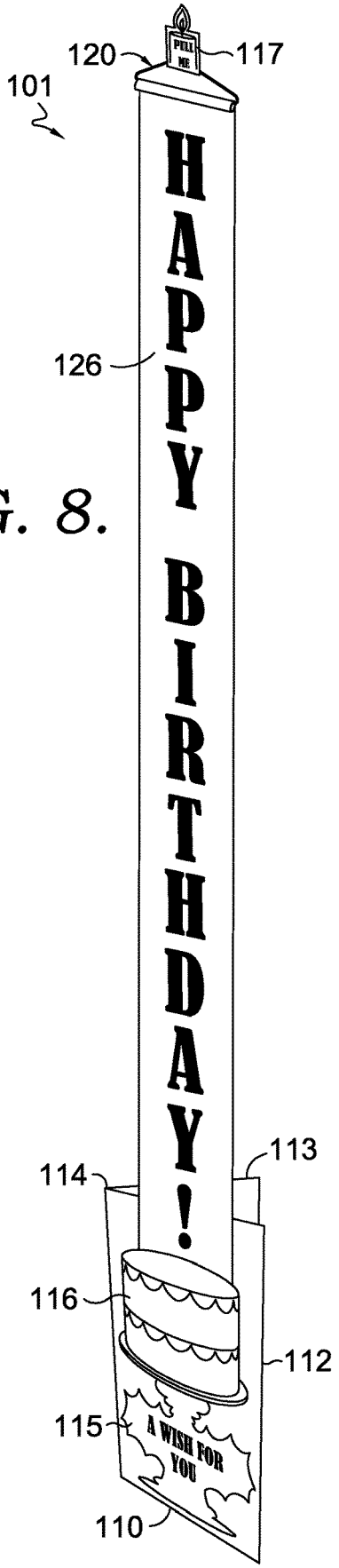

FIG. 7 shows the self-retracting banner apparatus 120 in mid transition between a closed position and an open position. FIG. 8 shows the self-retracting banner apparatus 120 in a fully open position. As can be seen, the banner content 126 comprises a "happy birthday" message, which complements and is a continuation of the card content 115. The font size used for the banner content 126 is larger than the font size used to print the card content 115. The font size used for the decorative card content 126 is large enough to be easily read from across a room, for example, from 20, 30, or even 40 feet away.

Many variations can be made to the illustrated embodiments of the present invention without departing from the scope of the present invention. Such modifications are within the scope of the present invention.

From the foregoing it will be seen that this invention is one well adapted to attain all ends and objects hereinabove set forth together with the other advantages which are clear following the complete disclosure above and which are inherent to the methods and apparatuses described herein. It will be understood that certain features and sub combinations are of utility and may be employed without reference to other features and sub combinations. This is contemplated by and is within the scope of the invention and claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

The invention claimed is:

1. An article having an unfurling banner, the article comprising:

a panel having card content thereon and at least a first subpanel and a second subpanel, the first subpanel and the second subpanel being separated by a fold in the panel; and a self-retracting banner apparatus comprising an unfurling banner having a first end and a second end, a spool attached to the first end of the unfurling banner, a handle coupled to the spool in a way that allows the spool to rotate freely, wherein the second end of the unfurling banner is coupled to the panel and is at least partially concealed, and wherein the unfurling banner includes banner content that is related to the card content.

2. The article of claim 1, further comprising a compartment coupled to the panel at a location that at least partially conceals some of the self-retracting banner apparatus when the self-retracting banner apparatus is in a closed position.

3. The article of claim 2, wherein the compartment comprises a decorative front portion and extensions attaching the decorative front portion to the panel.

4. The article of claim 3, wherein the extensions are attached to an exterior-facing side of the first subpanel.

5. The article of claim 1, wherein the unfurling banner is constructed from a plastic material having shape memory.

6. The article of claim 5, wherein the plastic material comprises polyethylene terephthalate.

7. The article of claim 1, wherein the second end is attached to an exterior-facing side of the panel.

8. The article of claim 1, wherein the handle includes a spool rod that at least partially fits inside an inner circumference of the spool.

9. An article having an unfurling banner comprising:

a panel having card content thereon;

a container attached to the panel;

a self-retracting banner apparatus comprising an unfurling banner having a first end and a second end, a spool attached to the first end of the unfurling banner, a handle coupled to the spool in a way that allows the spool to rotate freely, wherein the second end of the unfurling banner is coupled to the panel; and wherein the self-retracting banner apparatus is at least partially concealed by the container when the self-retracting banner apparatus is in a closed position.

10. The article of claim 9, wherein the container comprises a front portion and a connector that attaches the front portion to the panel.

11. The article of claim 10, wherein the second end of the unfurling banner is attached to a side of the panel behind the front portion.

12. The article of claim 10, wherein the front portion includes decorative content related to the card content.

13. The article of claim 10, wherein the unfurling banner includes banner content related to the card content.

14. The article of claim 13, wherein the banner content answers a question posed in the card content.

15. The article of claim 9, wherein the unfurling banner is constructed from a plastic material having shape memory.

16. A foldable article having an unfurling banner, the foldable article comprising:

a panel having at least a first subpanel and a second subpanel, the first subpanel and the second subpanel being separated by a fold in the panel, wherein the panel includes card content thereon;

a compartment formed by a front portion and extensions that attach to a back side of the front portion and an exterior-facing side of the first subpanel; and a self-retracting banner apparatus comprising an unfurling banner having a first end and a second end, a spool attached to the first end of the unfurling banner, a handle coupled to the spool in a way that allows the spool to rotate freely, and wherein the second end of the unfurling banner is coupled to the first subpanel at a location that is behind the front portion.

17. The foldable article of claim 16, wherein the unfurling banner is constructed from a plastic material having shape memory.

18. The foldable article of claim 17, wherein the plastic material comprises polyethylene terephthalate.

19. The foldable article of claim 16, wherein the self-retracting banner apparatus does not include a spring-loaded mechanism to power a self-retracting function.

20. The foldable article of claim 16, wherein the foldable article is a book.

* * * * *